US008849166B2

(12) United States Patent
Toichi

(10) Patent No.: US 8,849,166 B2
(45) Date of Patent: Sep. 30, 2014

(54) DEVELOPING DEVICE AND IMAGE FORMING APPARATUS

(71) Applicant: KYOCERA Document Solutions Inc., Osaka (JP)

(72) Inventor: Tetsuya Toichi, Osaka (JP)

(73) Assignee: KYOCERA Document Solutions Inc., Osaka-Shi (JP)

( * ) Notice: Subject to any disclaimer, the term of this patent is extended or adjusted under 35 U.S.C. 154(b) by 16 days.

(21) Appl. No.: 13/827,922

(22) Filed: Mar. 14, 2013

(65) Prior Publication Data

US 2013/0243494 A1 Sep. 19, 2013

(30) Foreign Application Priority Data

Mar. 16, 2012 (JP) ..... 2012-061111

(51) Int. Cl.
*G03G 15/08* (2006.01)

(52) U.S. Cl.
USPC ..... 399/282

(58) Field of Classification Search
CPC ..... G03G 15/0808; G03G 15/0818; G03G 15/0928; G03G 2215/0634; G03G 2215/0861; G03G 2215/0869
USPC ..... 399/272, 277, 281, 282
See application file for complete search history.

(56) References Cited

U.S. PATENT DOCUMENTS

| | | | | |
|---|---|---|---|---|
| 4,385,829 | A * | 5/1983 | Nakahata et al. | 399/282 |
| 4,669,852 | A * | 6/1987 | Tajima et al. | 399/282 |
| 6,917,780 | B2 * | 7/2005 | Ozawa et al. | 399/282 |
| 7,787,807 | B2 * | 8/2010 | Nakaue et al. | 399/277 |
| 8,699,925 | B2 * | 4/2014 | Kashimoto et al. | 399/272 |

FOREIGN PATENT DOCUMENTS

| | | | |
|---|---|---|---|
| JP | 07-128983 | A | 5/1995 |
| JP | 2000-250294 | A | 9/2000 |
| JP | 2006106028 | A * | 4/2006 |

* cited by examiner

*Primary Examiner* — Robert Beatty
(74) *Attorney, Agent, or Firm* — Knobbe Martens Olson & Bear LLP

(57) ABSTRACT

A developing device includes a developer supporting rotator, toner supporting rotator and voltage application unit. The toner supporting rotator is arranged opposite to a developer supporting rotator, supports toner supplied from the developer supporting rotator, and forms a toner layer by a magnetic brush. The voltage application unit causes the toner supported by the toner supporting rotator to an electrostatic latent image on a surface of an image carrier to develop it into a toner image. A longitudinal end portion of the toner supporting side magnetic member is positioned longitudinally more outside than a longitudinal end portion of the developer supporting side magnetic member. A surface of the second rotating sleeve positioned more outside than the end of the developer supporting side magnetic member is composed of a surface of low adherence with lower toner adherence and a higher dielectric constant than those of a surface positioned inside thereof.

4 Claims, 5 Drawing Sheets

DEVELOPING DEVICE AND IMAGE FORMING APPARATUS

INCORPORATION BY REFERENCE

This application is based on and claims the benefit of priority from Japanese Patent Application No. 2012-061111, filed on Mar. 16, 2012, the content of which is incorporated herein by reference.

BACKGROUND

The present disclosure relates to a developing device for developing an electrostatic latent image formed by electrophotography and an image forming apparatus provided with the developing device.

A developing device employing a touch-down type (also referred to as a hybrid type) is known. In the developing device of this type, a two-component developer including at least a carrier and toner is supported on a surface of a developer supporting rotator to form a magnetic brush on the surface by the carrier. In this type, the toner supplied from the magnetic brush to a toner supporting rotator forms a toner layer on a surface of the toner supporting rotator. The developing device causes the toner to fly from the toner layer thus formed to the image carrier so as to develop the electrostatic latent image on a surface of the image carrier into a toner image.

In the developing device of the touch-down type, a so-called development history may easily occur. The development history is a difference in developing performance at a time of subsequent rotation of the toner supporting rotator between a part where the toner is used for development and a part where the toner is not used to remain on the surface of the toner supporting rotator, of the toner of the toner layer formed on the surface of the toner supporting rotator. If the developing history occurs, the toner layer formed on the surface of the toner supporting rotator turns uneven. Accordingly, it is likely that the density of an image decreases due to a change in toner characteristics (particle size, triboelectric charge and the like), and the image quality degrades, the toner scatters, and developing defect such as developing ghost occurs due to long-neglected undeveloped toner.

In order to suppress an occurrence of the abovementioned developing defect, it is necessary to collect (strip) the undeveloped toner on the surface of the toner supporting rotator toward the developer supporting rotator between two successive operations of development and at a time without transfer of an image. As a method for stripping the undeveloped toner, a developing device has been known, in which a first time period is set shorter than a second time period. During the first time period, an alternating component of a bias voltage is applied to cause the undeveloped toner to migrate from the toner supporting rotator to the developer supporting rotator (strip and collection). During the second time period, an alternating component of a bias voltage is applied to cause the toner to migrate from the developer supporting rotator to the toner supporting rotator.

In addition, a developing device has been known, in which unevenness in a thickness of a toner layer between a part consuming the toner and a part without consuming the toner on the toner supporting rotator is configured to decrease. In order to decrease the unevenness, a magnetic member is disposed inside the developer supporting rotator, such that a half magnitude region having magnetic flux density of one half of a peak value of the magnetic member is set over a broad range where a gap is several times greater than the narrowest gap between the developer supporting rotator and the toner supporting rotator. In this manner, a time period during which the two-component developer is in contact with the surface of the toner supporting rotator increases and sufficiently supplies toner to the part consuming toner.

In the above-described developing device, density of the magnetic brush (mg/cm$^2$) and an orientation of an opposing magnetic brush at a time of the closest approach of the toner supporting rotator are important factors to perform stripping of the undeveloped toner on the surface of the toner supporting rotator. In other words, mechanical rubbing due to the density of the magnetic brush and the intensity of electric field between the toner supporting rotator and the developer supporting rotator (alternating component of a bias voltage on a stripping side) correlating to the orientation of the magnetic brush affect the stripping of the toner. In view of what has been described above, both of the above-described developing devices exert an effect of stripping the undeveloped toner in a developing region (image forming region) on the surface of the toner supporting rotator.

However, the effect of stripping the undeveloped and adhered toner is insufficient at longitudinal end portions of the toner supporting rotator, for the following reasons. Since the magnetic brush does not face the longitudinal end portions of the toner supporting rotator, a sneak magnetic field is formed at the longitudinal end portions of the developer supporting rotator. Since the direction of the sneak magnetic field is not in line with a normal vector connecting centers of the developer supporting rotator and the toner supporting rotator and is inclined relative to the normal line. Accordingly, the effect of stripping the undeveloped toner, for which the density and orientation of the magnetic brush are important factors, is not sufficiently exerted. As a result, the undeveloped toner adheres to (remains on) the surface of the longitudinal end portions of the toner supporting rotator and the undeveloped and adhered toner is electrically charged after successive operations. This may cause a problem of fogging at both end portions of a toner image on the surface of the image carrier.

SUMMARY

According to an aspect of the present disclosure, a developing device includes a developer supporting rotator, a toner supporting rotator, and a voltage application unit. The developer supporting rotator includes a first rotating sleeve and a developer supporting side magnetic member. The first rotating sleeve supports a two-component developer including at least a carrier and toner, and composes a longitudinally extending surface, on which a magnetic brush is formed by the carrier contained in the two-component developer. The developer supporting side magnetic member is disposed inside the first rotating sleeve and longitudinally extends. The toner supporting rotator includes a second rotating sleeve and a toner supporting side magnetic member. The second rotating sleeve is arranged opposite to the developer supporting rotator and composes a longitudinally extending surface, on which the toner supplied from the developer supporting rotator is supported and a toner layer is formed by the magnetic brush. The toner supporting side magnetic member is disposed inside the second rotating sleeve and longitudinally extends. The voltage application unit is configured to apply a developing bias voltage between the toner supporting rotator and the image carrier, such that the toner supported by the toner supporting rotator flies to an electrostatic latent image on a surface of an image carrier in order to develop the electrostatic latent image into a toner image. A longitudinal end portion of the toner supporting side magnetic member is positioned more longitudinally outside than a longitudinal end portion of the developer supporting side magnetic member. A surface of the second rotating sleeve positioned more outside than the end of the developer supporting side magnetic member is composed of a surface of low adherence having lower toner adherence and a higher dielectric constant than those of a surface positioned more inside.

DETAILED DESCRIPTION

An embodiment of an image forming apparatus according to the present disclosure will be described hereinafter with reference to the drawings.

Figure 1:
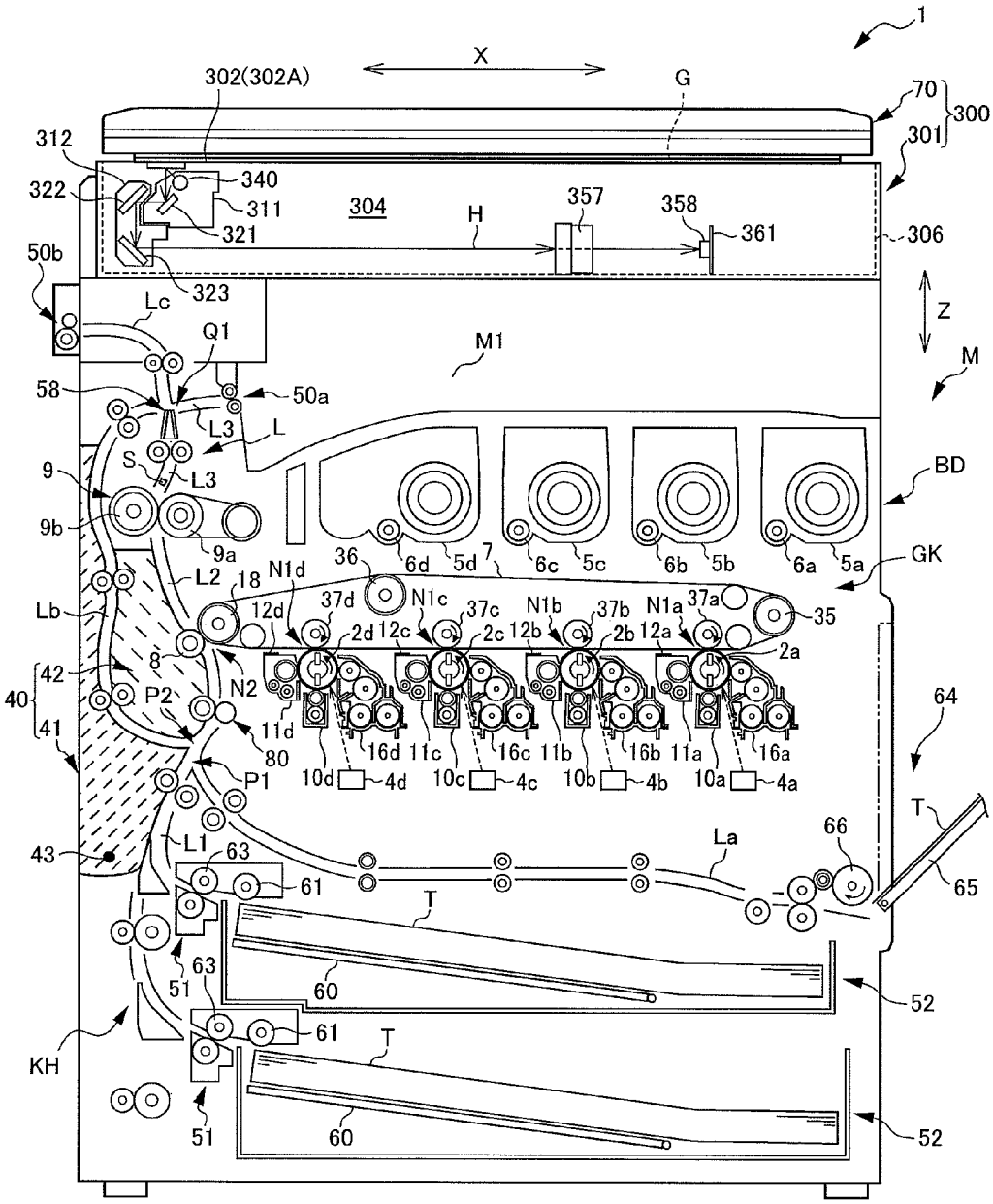
FIG. 1 is a diagram illustrating an arrangement of components of a copy machine 1 according to an embodiment of the present invention.

An overall structure of a copy machine 1 as an image forming device according to the present embodiment is described referring to FIG. 1. FIG. 1 is a diagram illustrating an arrangement of components of the copy machine 1.

As illustrated in FIG. 1, the copying machine 1 as an example of an image forming apparatus includes an image reading device 300 disposed in an upper portion in a vertical direction Z and the main body M disposed in a lower portion of the copying machine 1. A main body M forms a toner image on a sheet of paper T, as a sheet-shaped recording medium, based on image information read by an image reading device 300.

It should be noted that, in a description of the copy machine 1, a secondary scanning direction X is also referred to as "left-right direction" and a primary scanning direction Y (a direction across FIG. 1) is also referred to as "front-rear direction" of the copy machine 1. The vertical direction Z of the copy machine 1 is orthogonal to the secondary scanning direction X and the primary scanning direction Y.

First, the image reading device 300 is described.

As shown in FIG. 1, the image reading device 300 includes a cover 70 and a reading unit 301 that reads an image on a document G.

The cover 70 is connected openably and closably with the reading unit 301 by a connecting portion (not illustrated). The cover 70 protects a reading surface 302A (described later).

The reading unit 301 includes a housing 306 and the reading surface 302A disposed on an upper side of the housing 306. In addition, the reading unit 301 includes an illumination unit 340 including a light source disposed in an internal space 304 of the housing 306, a plurality of mirrors 321, 322, and 323, a first frame 311 and a second frame 312 that move in the secondary scanning direction X, an imaging lens 357, a CCD 358 as a reading device, and a CCD printed board 361 that performs a predetermined process on image information read by the CCD 358 and outputs the image information to the main body M. The illumination unit 340 and the mirror 321 are accommodated in the first frame 311. The second mirror 322 and the third mirror 323 are accommodated in the second frame 312.

The reading surface 302A extends in an in-plane direction defined by the secondary scanning direction X and the primary scanning direction Y, and occupies a large part of the reading unit 301 in the secondary scanning direction X. The document G is placed on the reading surface 302A. The first frame 311 and the second frame 312 move in the secondary scanning direction X while maintaining a length of a light path H (described later) constant. As a result, an image of the document G placed on the reading surface 302A is read.

In the internal space 304 of the housing 306, the plurality of mirrors 321, 322 and 323 forms a light path H so that light from the document G is incident upon the imaging lens 357. In addition, since the first frame 311 moves in a secondary scanning direction X at a predetermined speed A while the second frame 312 moves in the secondary scanning direction X at a predetermined speed A/2, the length of the light path H is kept constant even while reading of an image is performed. As a result, an image of the document G placed on the reading surface 302A is read.

Next, the main body M is described.

The main body M includes an image forming unit GK that forms a predetermined toner image on a sheet of paper T based on predetermined image information, and a paper feeding/discharge unit KH that feeds the sheet of paper T to the image forming unit GK and discharges the sheet of paper T on which a toner image is formed.

The external shape of the main body M is composed of a casing BD as a housing.

As shown in FIG. 1, the image forming unit GK includes photosensitive drums 2*a*, 2*b*, 2*c*, and 2*d* as image carriers (photosensitive bodies), charging units 10*a*, 10*b*, 10*c*, and 10*d*, laser scanner units 4*a*, 4*b*, 4*c*, and 4*d* as exposure units, developing devices 16*a*, 16*b*, 16*c*, and 16*d*, toner cartridges 5*a*, 5*b*, 5*c*, and 5*d*, toner feeding units 6*a*, 6*b*, 6*c*, and 6*d*, drum cleaning units 11*a*, 11*b*, 11*c*, and 11*d*, static eliminator 12*a*, 12*b*, 12*c*, and 12*d*, an intermediate transfer belt 7, primary transfer rollers 37*a*, 37*b*, 37*c*, and 37*d*, a secondary transfer roller 8, an opposing roller 18, and a fusing unit 9.

As shown in FIG. 1, the paper feeding/discharge portion KH includes a paper feeding cassette 52, a manual feeding portion 64, a paper path L for a sheet of paper T, a pair of registration rollers 80, a first discharge portion 50*a*, and a second discharge portion 50*b*. It should be noted that the paper path L includes a first paper path L1, a second paper path L2, a third paper path L3, a manual paper path La, a reverse paper path Lb, and a post-processing paper path Lc.

Components of the image forming unit GK and the paper feeding/discharge unit KH are described in detail hereinafter.

First, a description is provided for the image forming unit GK.

In the image forming unit GK, charging by the charging units 10*a*, 10*b*, 10*c* and 10*d*, exposure by the laser scanner units 4*a*, 4*b*, 4*c* and 4*d*, development by the developing devices 16*a*, 16*b*, 16*c* and 16*d*, primary image transfer by the intermediate transfer belt 7 and the primary transfer rollers 37*a*, 37*b*, 37*c* and 37*d*, static elimination by the static eliminators 12*a*, 12*b*, 12*c* and 12*d*, and cleaning by the drum cleaning units 11*a*, 11*b*, 11*c* and 11*d*, are performed on surfaces of the photosensitive drums 2*a*, 2*b*, 2*c* and 2*d*, sequentially from upstream to downstream. In addition, secondary image transfer by the intermediate transfer belt 7, the secondary image transfer roller 8 and the opposing roller 18, and fixation by the fusing unit 9 are performed in the image forming unit GK.

Each of the photosensitive drums 2*a*, 2*b*, 2*c*, and 2*d* is cylindrically shaped and functions as a photosensitive body or an image carrier. Each of the photosensitive drums 2*a*, 2*b*, 2*c*, and 2*d* is disposed rotatable in a direction of an arrow, about a shaft orthogonal to a direction of movement of the intermediate transfer belt 7. An electrostatic latent image is formed on a surface of each of the photosensitive drums 2*a*, 2*b*, 2*c*, and 2*d*.

Each of the charging units 10*a*, 10*b*, 10*c*, and 10*d* is disposed opposite to a surface of the photosensitive drums 2*a*, 2*b*, 2*c*, and 2*d*. Each of the charging units 10*a*, 10*b*, 10*c*, and 10*d* negatively (negative polarity) or positively (positive polarity) charges a surface of each of the photosensitive drums 2*a*, 2*b*, 2*c*, and 2*d* uniformly.

Each of the laser scanner units 4*a*, 4*b*, 4*c*, and 4*d*, which functions as an exposure units, is disposed to be spaced apart from a surface of the photosensitive drums 2*a*, 2*b*, 2*c*, and 2*d*. Each of the laser scanner units 4*a*, 4*b*, 4*c*, and 4*d* includes a laser light source, a polygonal mirror, a polygonal mirror driving motor and the like, which are not illustrated.

Each of the laser scanner units 4*a*, 4*b*, 4*c*, 4*d* scans and exposes a surface of each of the photosensitive drums 2*a*, 2*b*, 2*c*, 2*d* based on the information related to the image read by the reading unit 301. In this way, an electric charge of an exposed part of a surface of each of the photosensitive drums 2*a*, 2*b*, 2*c*, and 2*d* is removed. In this way, an electrostatic latent image is formed on a surface of each of the photosensitive drums 2*a*, 2*b*, 2*c*, and 2*d*.

The developing devices 16*a*, 16*b*, 16*c*, and 16*d* are disposed to correspond to the photosensitive drums 2*a*, 2*b*, 2*c*, and 2*d*, respectively, opposite to respective surfaces of the photosensitive drums 2*a*, 2*b*, 2*c*, and 2*d*. Each of the developing devices 16*a*, 16*b*, 16*c*, and 16*d* forms a color toner image on a surface of each of the photosensitive drums 2*a*, 2*b*, 2*c*, and 2*d* by depositing toners of various colors on an electrostatic latent image formed on the surface of each of the photosensitive drums 2*a*, 2*b*, 2*c*, and 2*d*. The developing devices 16*a*, 16*b*, 16*c*, and 16*d* correspond to four colors of yellow, cyan, magenta, and black, respectively. Details of the developing devices 16*a*, 16*b*, 16*c* and 16*d* will be described later.

The toner cartridges 5*a*, 5*b*, 5*c*, and 5*d* are provided corresponding to the developing devices 16*a*, 16*b*, 16*c*, and 16*d*, respectively, and store the toners of different colors that are supplied to the developing devices 16*a*, 16*b*, 16*c*, and 16*d*, respectively. The toner cartridges 5*a*, 5*b*, 5*c*, and 5*d* store toners of yellow, cyan, magenta, and black respectively.

The toner feeding units 6*a*, 6*b*, 6*c*, and 6*d* are provided to correspond to the toner cartridges 5*a*, 5*b*, 5*c*, and 5*d* and the developing devices 16*a*, 16*b*, 16*c*, and 16*d*, respectively. And the toner feeding units 6*a*, 6*b*, 6*c*, and 6*d* supply the toners of the respective colors stored in the toner cartridges 5*a*, 5*b*, 5*c*, and 5*d* to the developing devices 16*a*, 16*b*, 16*c*, and 16*d*, respectively. The toner feeding units 6*a*, 6*b*, 6*c*, and 6*d* are connected with the developing devices 16*a*, 16*b*, 16*c*, and 16*d*, respectively, via toner feeding paths (not illustrated).

Toner images of respective colors formed on the photosensitive drums 2*a*, 2*b*, 2*c*, and 2*d* are primarily transferred in sequence to the intermediate transfer belt 7. The intermediate transfer belt 7 is stretched around a driven roller 35, the opposing roller 18 composed of a driving roller, a tension roller 36 and the like. As the tension roller 36 biases the intermediate transfer belt 7 from inside to outside, a predetermined tension is applied to the intermediate transfer belt 7.

Primary transfer rollers 37*a*, 37*b*, 37*c*, and 37*d* are arranged to face the photosensitive drums 2*a*, 2*b*, 2*c*, and 2*d*, respectively, across the intermediate transfer belt 7.

Predetermined parts of the intermediate transfer belt 7 are sandwiched between the primary transfer rollers 37*a*, 37*b*, 37*c*, and 37*d* and the photosensitive drums 2*a*, 2*b*, 2*c*, and 2*d*. The predetermined sandwiched parts are pressed against surfaces of the photosensitive drums 2*a*, 2*b*, 2*c*, and 2*d*. Primary transfer nips N1*a*, N1*b*, N1*c*, and N1*d* are thus formed between the photosensitive drums 2*a*, 2*b*, 2*c*, and 2*d* and the primary transfer rollers 37*a*, 37*b*, 37*c*, and 37*d*, respectively. At the primary transfer nips N1*a*, N1*b*, N1*c*, and N1*d*, toner images of the respective colors developed on the photosensitive drums 2*a*, 2*b*, 2*c*, and 2*d* undergo primary transfer sequentially onto the intermediate transfer belt 7. In this manner, a full-color toner image is formed on the intermediate transfer belt 7.

A primary image transfer bias is applied to each of the primary transfer rollers 37*a*, 37*b*, 37*c*, and 37*d* by a primary image transfer bias application unit (not illustrated). Due to the primary image transfer bias, a toner image of each color formed on each of the photosensitive drums 2*a*, 2*b*, 2*c*, and 2*d* is transferred onto the intermediate transfer belt 7.

Each of the static eliminators 12*a*, 12*b*, 12*c*, and 12*d* is disposed so as to face a surface of each of the photosensitive drums 2*a*, 2*b*, 2*c*, and 2*d*. Each of the static eliminators 12*a*, 12*b*, 12*c*, and 12*d* casts light on a surface of the photosensitive drums 2*a*, 2*b*, 2*c*, and 2*d* after primary transfer to neutralize the surface (remove electric charge from the surface).

Each of the drum cleaning units 11*a*, 11*b*, 11*c*, and 11*d* is arranged opposite to a surface of the photosensitive drums 2*a*, 2*b*, 2*c*, and 2*d*. The drum cleaning units 11*a*, 11*b*, 11*c*, and 11*d* remove toner and attached matter remaining on the surfaces of the photosensitive drums 2*a*, 2*b*, 2*c*, and 2*d*, respectively, and transfer the removed toner to a collection mechanism. The toner thus conveyed is collected by the collection mechanism.

The secondary transfer roller 8 secondarily transfers the full-color toner image, which has been primarily transferred to the intermediate transfer belt 7, to a sheet of paper T. A secondary bias is applied to the secondary image transfer roller 8 to transfer the full-color toner image formed on the intermediate transfer belt 7 to the sheet of paper T by the primary transfer bias application part (not illustrated).

The secondary transfer roller 8 comes into contact with and moves away from the intermediate transfer belt 7. More specifically, the secondary transfer roller 8 is configured to be movable between a contact position at which it is in contact with the intermediate transfer belt 7 and a spaced position at which it is spaced apart from the intermediate transfer belt 7. In particular, the secondary transfer roller 8 is disposed at the contact position for transferring the toner image primarily transferred to a surface of the intermediate transfer belt 7 to the sheet of paper T, and at the spaced position in all other circumstances.

The opposing roller 18 is arranged opposite to the secondary transfer roller 8 across the intermediate transfer belt 7. A predetermined part of the intermediate transfer belt 7 is sandwiched between the secondary transfer roller 8 and the opposing roller 18. The sheet of paper T is pressed against an outer surface (a surface to which the toner image is primarily transferred) of the intermediate transfer belt 7. A secondary transfer nip N2 is formed between the intermediate transfer belt 7 and the secondary transfer roller 8. At the secondary transfer nip N2, the full-color toner image primarily transferred to the intermediate transfer belt 7 is secondarily transferred to the sheet of paper T.

The fusing part 9 fuses and pressurizes respective color toners forming the toner image that has been secondarily transferred to the sheet of paper T, so as to fix the color toners on the sheet of paper T. The fusing unit 9 includes a heating rotator 9*a* that is heated by a heater, and a pressing rotator 9*b* that is brought into pressure-contact with the heating rotator 9*a*. The heating rotator 9*a* and the pressing rotator 9*b* sandwich and compress the sheet of paper T to which the toner image is secondarily transferred, while feeding the sheet of paper T. The sheet of paper T is conveyed in a state of being interposed between the heating rotator 9*a* and the pressing rotator 9*b*. In this way, the toner transferred onto the sheet of paper T is fused, pressed and fixed onto the sheet of paper T.

Next, the paper feeding/discharge unit KH is described.

As shown in FIG. 1, two paper cassettes 52 for accommodating sheets of paper T are disposed one above another at a lower portion of the main body M. The paper feeding cassette 52 is configured to be manually drawable in a horizontal direction from a housing of the main body M. The paper feeding cassette 52 includes a paper tray 60 on which the sheets of paper T are placed. The paper feeding cassette 52 accommodates the sheets of paper T stacked on the paper tray 60. The sheets of paper T placed on the paper tray 60 are fed to the paper path L by a cassette feeding part 51 disposed in an end part of the paper feeding cassette 52 on a side of feeding the paper (in a left end part of FIG. 1). The cassette feeding unit 51 includes a double feed prevention mechanism including a forward feed roller 61 for picking up a sheet of paper T on the paper tray 60 and a pair of paper feeding rollers 63 for feeding the sheets of paper T sheet by sheet to the paper path L.

The manual feeding unit 64 is provided on a right lateral face (the right side in FIG. 1) of the main body M. The manual feeding unit 64 is provided in order to feed other sheets of paper T to the main body M, which are different in size and type from the sheets of paper T accommodated in the paper feeding cassette 52. The manual feeding unit 64 includes a manual feeding tray 65, which becomes a portion of a right lateral face of the main body M when the manual feeding unit 64 is closed, and a paper feeding roller 66 as the conveying roller. The manual feeding tray 65 functions as a mounting part on which at least a sheet of paper T can be placed in an open state, and a lower end thereof is rotatably attached in a vicinity of the paper feeding roller 66 (openable and closable). The paper feeding roller 66 feeds a sheet of paper T placed on the manual feeding tray 65 while it is open, to the manual feeding path La inside the housing 306.

A first discharge portion 50*a* and a second discharge portion 50*b* are provided on an upper side of the main body M. The first discharge portion 50*a* and the second discharge portion 50*b* discharge a sheet of paper T outside the main body M. The first discharge portion 50*a* and the second discharge portion 50*b* will be described later in detail.

The paper path L includes the first paper path L1 from the cassette feeding unit 51 to the secondary transfer nip N2, the second paper path L2 from the secondary transfer nip N2 to the fusing unit 9, the third paper path L3 from the fusing unit 9 to the first discharge portion 50*a*, the manual paper path La that guides a sheet of paper T fed from the manual feeding unit 64 to the first paper path L1, the reverse paper path Lb that reverses and returns a sheet of paper T that is conveyed in the third paper path L3 from upstream to downstream to the first paper path L1, and the post-processing paper path Lc that conveys a sheet of paper T that is conveyed in the third paper path L3 from upstream to downstream to a post-processing device (not shown) connected to the second discharge portion 50*b*.

In addition, a first junction P1 and a second junction P2 are provided midway in the first paper path L1. A first branch part Q1 is provided midway in the third paper path L3.

The manual paper path La merges with the first paper path L1 at the first junction P1. The reverse paper path Lb merges with the first paper path L1 at the second junction P2.

The post-processing paper path Lc branches off from the third paper path L3 at the first branch portion Q1. A switching member 58 is provided at the first branch portion Q1. The switching member 58 switches a conveying direction of a sheet of paper T discharged from the fusing unit 9 to the third paper path L3 toward the first discharge portion 50*a* or to the post-processing paper path Lc toward the second discharge portion 50*b*.

In addition, a sensor for detecting a sheet of paper T and a pair of registration rollers 80 for skew correction of a sheet of paper T and timing adjustment with formation of the toner image in the image forming unit GK are disposed midway in the first paper path L1 (more specifically, between the second junction P2 and the secondary transfer roller 8). The sensor is disposed immediately before the pair of registration rollers 80 in the conveyance direction of a sheet of paper T (upstream in the conveyance direction). The pair of registration rollers 80 conveys the sheet of paper T by performing the aforementioned correction and timing adjustment based on a detection signal sent from the sensor.

A sensor S for detecting a sheet of paper T is disposed midway at the third paper path L3 (more specifically, between the fusing unit 9 and the first branch portion Q1). The sensor S is disposed downstream of the fusing unit 9 in the conveying direction of a sheet of paper T. The sensor S outputs a detection signal when it detects a printed sheet of paper T pass.

For a case of performing duplex printing of a sheet of paper T, the reverse paper path Lb forms an image on a surface (an unprinted surface) opposite to a surface that has already been printed. The reverse paper path Lb can reverse a sheet of paper T, fed from the first branch portion Q1 toward the discharge portion 50, and returns the sheet of paper T to the first paper path L1 in order to feed the sheet of paper T to upstream of the pair of registration rollers 80 disposed upstream of the secondary transfer roller 8. At the secondary transfer nip N2, a toner image is transferred to the unprinted surface of the sheet of paper T that has been reversed by the return paper path Lb.

The first discharge portion 50*a* is formed in an end portion of the third paper path L3. The first discharge portion 50*a* is disposed in an upper portion of the main body M. The first discharge portion 50*a* has an opening toward a right lateral face of the main body M (right side in FIG. 1 and on a side of the manual feeding unit 64). The first discharge portion 50*a* discharges a sheet of paper T that is conveyed in the third paper path L3 outside the main body M.

A discharged paper collection part M1 is formed on a side of the opening of the first discharge portion 50*a*. The discharged paper collection part M1 is formed on an upper face (outer face) of the main body M. The discharged paper collection part M1 is a portion of the upper face of the main body M recessed downward. The bottom face of the discharged paper collection part M1 constitutes a part of the upper face of the main body M. A sheet of paper T on which a predetermined toner image is formed and which is discharged from the first discharge portion 50*a* is stacked at the discharged paper collection part M1.

The second discharge portion 50*b* is formed in an end portion of the post-processing paper path Lc. The second discharge portion 50*b* is disposed in an upper portion of the main body M. The second discharge portion 50*b* has an opening toward a left lateral face of the main body M (left side in FIG. 1 and on a side to which the post-processing device is connected).

The second discharge portion 50*b* discharges a sheet of paper T, which is conveyed in the post-processing paper path Lc, outside the main body M. The post-processing device (not shown) is connected to a side of the opening of the second discharge portion 50*b*. The post-processing device performs post processing (stapling, punching and the like) of sheets of paper discharged from the image forming apparatus (copy machine 1).

A sensor for detecting a sheet of paper is disposed at a predetermined position of each paper path.

Next, a structure for eliminating paper jams in main paper paths L1 to L3 (the first paper path L1, the second paper path L2, and the third paper path L3 are also collectively referred to as "main paper paths" hereinafter) and in the reverse paper path Lb is briefly described.

As shown in FIG. 1, on a left lateral face side of the main body M (left side in FIG. 1), the main paper paths L1 to L3 and the reverse paper path Lb extend in parallel mainly in a vertical direction. On a left lateral face side of the main body M (left side in FIG. 1), a cover assembly 40 is provided so as to form a part of the lateral face of the main body M. A lower end portion of the cover assembly 40 is connected with the main body M via a fulcrum shaft 43. The fulcrum shaft 43 is disposed along a direction intersecting the main paper paths L1 to L3 and the reverse paper path Lb. The cover assembly 40 is configured to be pivotable about the fulcrum shaft 43 between a closed position (shown in FIG. 1) and an opened position (not illustrated).

The cover assembly 40 includes a first cover 41 and a second cover 42. These covers are pivotally connected with the main body M via the fulcrum shaft 43. The first cover 41 is positioned more external (lateral face side) of the main body M than the second cover 42. It should be noted that, in FIG. 1, the first cover 41 is a part hatched with falling diagonal broken lines from top right to bottom left, and the second cover 42 is a part hatched with falling diagonal broken lines from top left to bottom right.

When the cover assembly 40 is in a closed position, an outer face of the first cover 41 constitutes a part of an outer face (lateral face) of the main body M.

In addition, when the cover assembly 40 is in the closed position, an inner face (a side of the main body M) of the second cover 42 constitutes a portion of the main paper paths L1 to L3.

Furthermore, when the cover assembly 40 is in the closed position, an inner face of the first cover 41 and an outer face of the second cover 42 constitute at least a part of the reverse paper path Lb. In other words, the reverse paper path Lb is formed between the first cover 41 and the second cover 42.

Since the copy machine 1 according to the present embodiment is provided with the cover assembly 40 thus configured, in a case in which a paper jam occurs in the main paper paths L1 to L3, jammed paper in the main paper paths L1 to L3 can be removed by opening the main paper paths L1 to L3 by pivoting the cover assembly 40 from the closed position shown in FIG. 1 to the opened position (not illustrated). On the other hand, in a case in which a paper jam occurs in the reverse paper path Lb, jammed paper in the reverse paper path Lb can be removed by opening the reverse paper path Lb by pivoting the cover assembly 40 to the opened position and then pivoting the second cover 42 about the fulcrum shaft 43 toward the main body M (right side in FIG. 1).

Next, a configuration of the developing devices 16*a*, 16*b*, 16*c*, 16*d*, which is a characterizing part of the copy machine 1 according to the present embodiment, is described with reference to FIGS. 2 to 5. As described above, the copy machine 1 includes four developing devices 16*a*, 16*b*, 16*c*, 16*d*, which are similarly configured. A developing device 16*a* is described hereinafter as an example.

Figure 2:
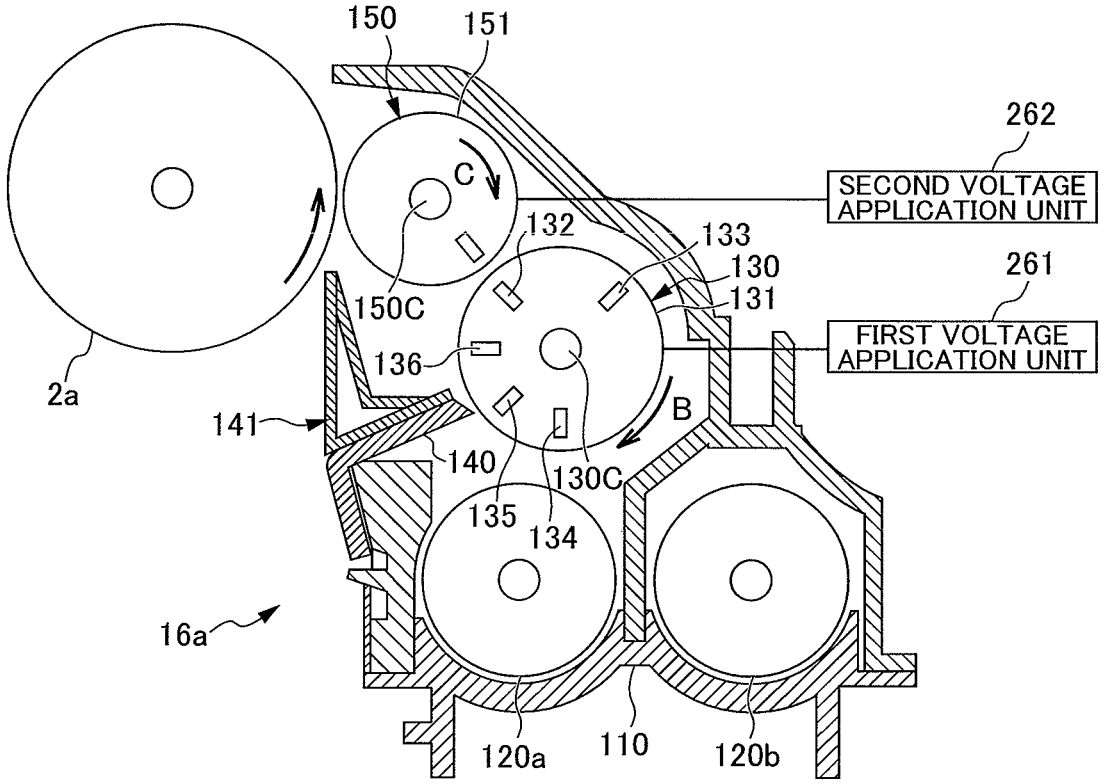
FIG. 2 is a cross-sectional view illustrating a developing device 16*a* and a photosensitive drum 2*a* of the copy machine according to the present embodiment.
Figure 3:
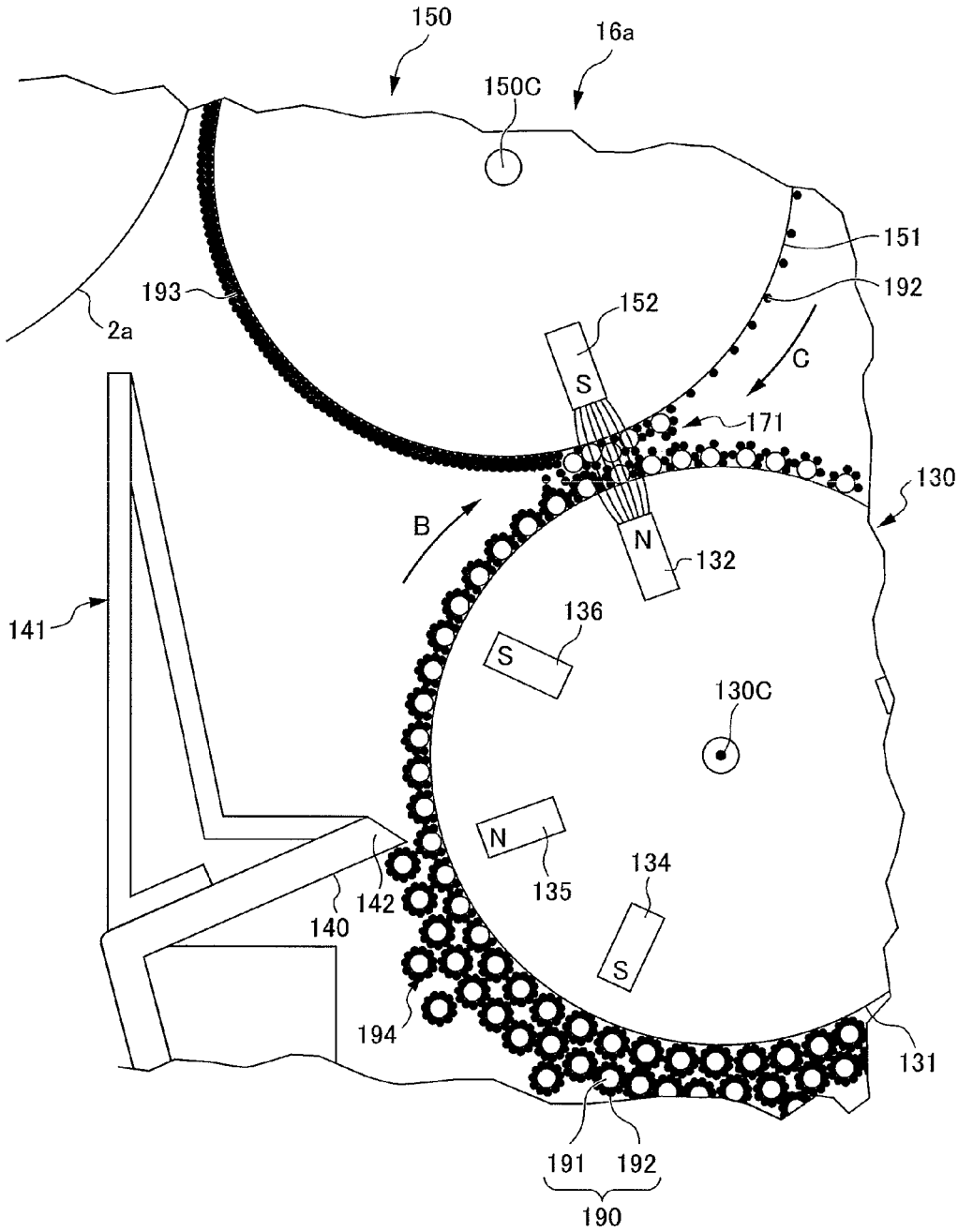
FIG. 3 is a partially enlarged view illustrating a state in which a toner 192 is conveyed in a vicinity at which a magnetic roller 130 and a developing roller 150 are opposite to each other.
Figure 4:
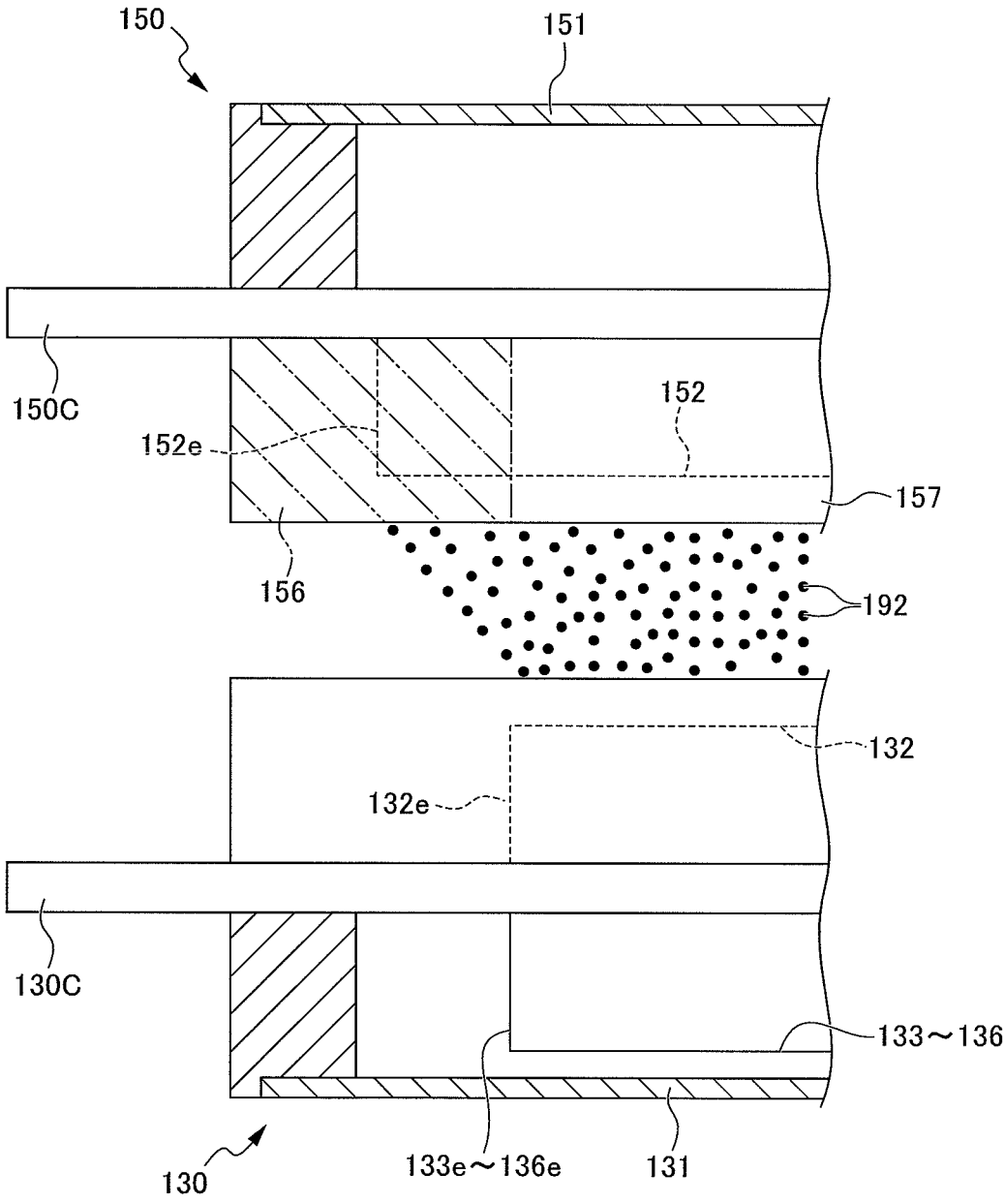
FIG. 4 is an enlarged cross-sectional view illustrating a vicinity of longitudinal end portions of the developing roller 150 and the magnetic roller 130.
Figure 5:
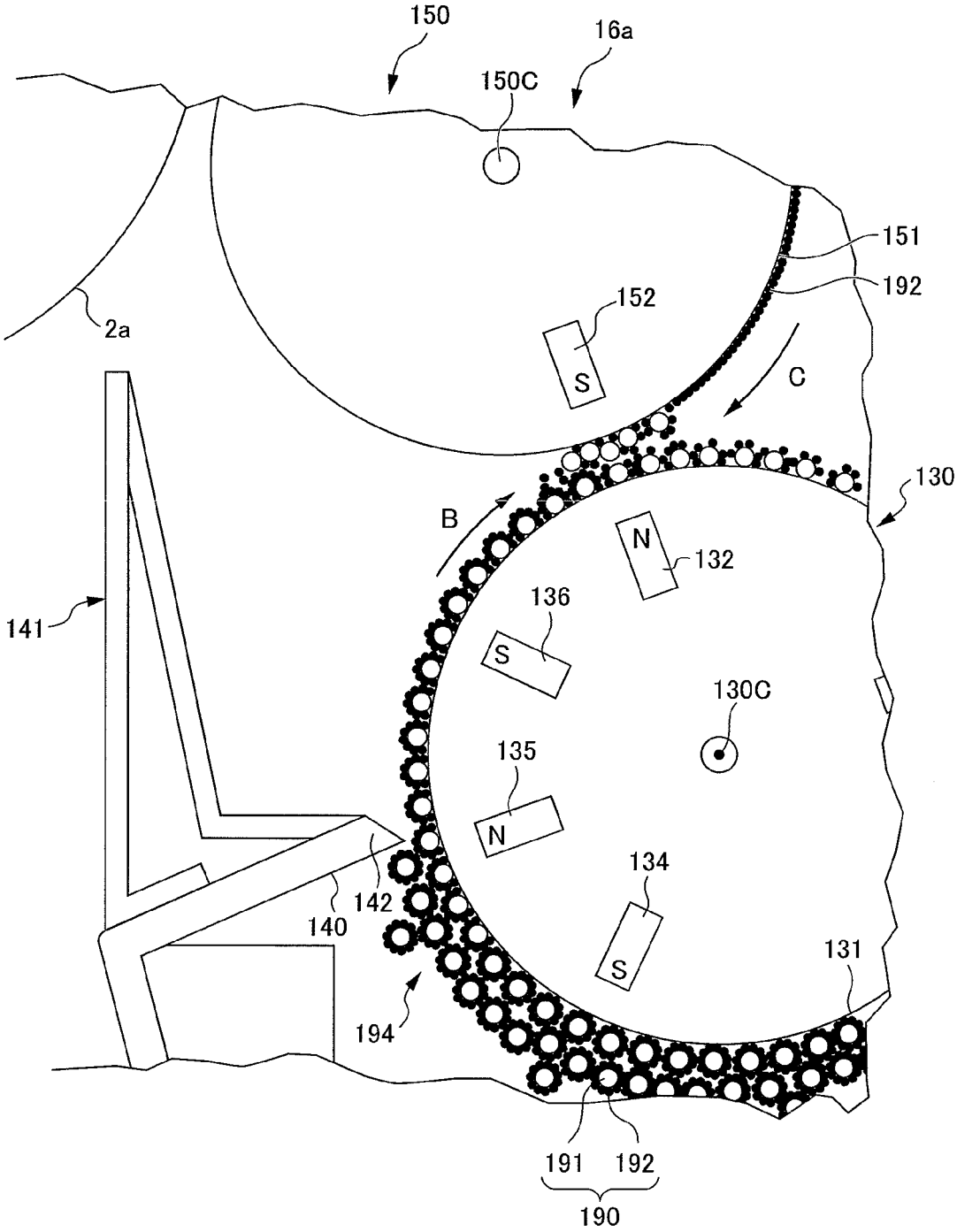
FIG. 5 is a diagram illustrating a state in which a substantially entire amount of the toner 192 is stripped from a surface of the developing roller 150 in a stripping operation.

FIG. 2 is a cross-sectional view illustrating the developing device 16*a* and a photosensitive drum 2*a* of the copy machine according to the present embodiment. FIG. 3 is a partially enlarged view illustrating a toner 192 being conveyed in a vicinity where the magnetic roller 130 and the developing roller 150 are opposite to each other. FIG. 4 is an enlarged cross-sectional view illustrating the vicinity of longitudinal end portions of the developing roller 150 and the magnetic roller 130. FIG. 5 is a diagram illustrating a state in which a substantially entire amount of the toner 192 is stripped from the surface of the developing roller 150 in a stripping operation.

As shown in FIGS. 2 and 3, the developing device 16*a* of the present embodiment includes a developer container 110, agitation rollers 120*a*, 120*b*, the magnetic roller 130, a layer thickness regulation blade (regulation member) 140, a scattered toner catcher cover 141, the developing roller 150, a first voltage application unit 261, and a second voltage application unit 262.

The developer container 110 accommodates the two-component developer 190 including at least a magnetic carrier 191 and toner 192. The agitation rollers 120*a*, 120*b* are disposed inside the developer container 110. The magnetic roller 130 is disposed vertically above one agitation rollers 120*a* and functions as a developer supporting rotator. The layer thickness regulation blade 140 is disposed close to the magnetic roller 130. The scattered toner catcher cover 141 is disposed vertically above the layer thickness regulation blade 140. The developing roller 150 as a toner supporting rotator is arranged to face the magnetic roller 130.

The toner 192 is supplied from the toner cartridge 5*a* (see FIG. 1) to the developer container 110 via the toner supply unit 6*a* (see FIG. 1).

The agitation rollers 120*a*, 120*b* agitate the two-component developer 190 accommodated in the developer container 110. In the two-component developer 190 thus agitated, static electricity is generated due to friction. In the present embodiment, the magnetic carrier (carrier) 191 is negatively charged and the toner 192 is positively charged. With an electrostatic force, the toner 192 adheres to the magnetic carrier 191.

As shown in FIGS. 3 and 4, the magnetic roller 130 includes a first rotating sleeve 131 and a plurality of developer supporting side magnetic members 132 to 136. The first rotating sleeve 131 is rotatable about a rotational shaft 130C in a predetermined direction, and extends in the longitudinal direction (direction of a rotational shaft) while composing a surface of the magnetic roller 130. The developer supporting side magnetic members 132 to 136 are disposed inside the first rotating sleeve 131 and extend in the longitudinal direction.

The first rotating sleeve 131 is composed of a non-magnetic material and has a cylindrical shape. The first rotating sleeve 131 is rotationally driven in a direction of an arrow B shown in FIGS. 2 and 3. The first voltage application unit 261 applies a first bias voltage, in which a direct current and an alternating current are superposed, to the first rotating sleeve 131.

As shown in FIGS. 2 and 3, the plurality of developer supporting side magnetic members 132 to 136 is fixed at predetermined intervals in a rotational direction of the magnetic roller 130 inside the first rotating sleeve 131.

The first developer supporting side magnetic member 132 is fixed at a position closest to the developing roller 150 (described later) of the magnetic roller 130. The first developer supporting side magnetic member 132 is arranged such that an N pole is directed outward (toward a circumferential surface of the first rotating sleeve 131).

The other developer supporting side magnetic members 133 to 136 are fixed at predetermined intervals in the rotational direction B with respect to the first developer supporting side magnetic member 132, inside the first rotating sleeve 131. The developer supporting side magnetic members 133, 134, 136 are each arranged such that an S pole is directed outward (toward the circumferential surface of the first rotating sleeve 131). The developer supporting side magnetic member 135 is arranged such that an N pole is directed outward (toward the circumferential surface of the first rotating sleeve 131).

As shown in FIG. 3, a part of the two-component developer 190 accommodated in the developer container 110 is retained on the surface of the magnetic sleeve 131 through magnetic forces of the developing agent supporting side magnetic members 132 to 136. In addition, the two-component developer 190 retained on the surface of the first rotating sleeve 131 forms a developer layer (magnetic brush 194).

The layer thickness regulation blade 140 is positioned below a horizontal surface passing through a center of the rotational shaft 130C of the magnetic roller 130. Since the layer thickness regulation blade 140 has a tip portion 142 configured to be opposite to and close to the surface of the magnetic roller 130, the thickness (height) of the developer layer 194 formed of the two-component developer 190 supported on the surface of the magnetic roller 130 is regulated. As a result, the thickness of the developer layer 194 having passed through the layer thickness regulation blade 140 is maintained constant. The layer thickness regulation blade 140 is composed of a plate-like member and a predetermined gap is formed between the tip portion 142 of the layer thickness regulation blade 140 and the first rotating sleeve 131.

The scattered toner catcher cover 141 is a member composing a part of a casing of the developing device 16*a*. The scattered toner catcher cover 141 is disposed above the layer thickness regulation blade 140 and prevents the toner 192 from scattering outside the developing device 16*a*.

As shown in FIGS. 3 and 4, the developing roller 150 is arranged opposite to the magnetic roller 130. The toner 192 supplied from the magnetic roller 130 is supported to form a toner layer 193 on the surface of the developing roller 150. More specifically, the toner 192 migrates from the developer layer (magnetic brush) 194, of which thickness is regulated by the layer thickness regulation blade 140, to form the toner layer 193 on the surface of the developing roller 150.

The developing roller 150 includes a second rotating sleeve 151 and a toner supporting side magnetic member 152. The second rotating sleeve 151 is rotatable about a rotational shaft 150C in a predetermined direction, and extends in the longitudinal direction (direction of a rotational shaft) while composing a surface of the developing roller 150. The toner supporting side magnetic member 152 is disposed inside the second rotating sleeve 151 and extends in the longitudinal direction.

The second rotating sleeve 151 is composed of a non-magnetic material and has a cylindrical shape. The second rotating sleeve 151 opposite to the first rotating sleeve 131 is rotationally driven in a direction of an arrow C shown in FIGS. 2 and 3.

The second voltage application unit 262 applies a second bias voltage, in which a direct current and an alternating current are superposed, to the second rotating sleeve 151 of the developing roller 150.

The developer supporting side magnetic members 132 to 136 are fixed inside the first rotating sleeve 131. The toner supporting side magnetic member 152 is fixed opposite to the first developer supporting side magnetic member 132, inside the second rotating sleeve 151. The first developer supporting side magnetic member 132 and the toner supporting side magnetic member 152 are arranged opposite to each other across a region in which the second rotating sleeve 151 and the first rotating sleeve 131 are closest to each other.

An end portion of the toner supporting side magnetic member 152 directed to the first developer supporting side magnetic member 132 has an opposite polarity to that of an outer side of the first developer supporting side magnetic member 132. In other words, the toner supporting side magnetic member 152 is arranged such that an S pole is directed outward (toward a circumferential surface of the second rotating sleeve 151).

As a result, a first magnetic field 171 is generated between the first developer supporting side magnetic member 132 disposed inside the magnetic roller 130 and the toner supporting side magnetic member 152 disposed inside the developing roller 150. In a region in which the magnetic field 171 is generated between the magnetic roller 130 and the developing roller 150, the developer layer 194 rises from the surface of the magnetic roller 130 under the influence of the magnetic field 171 to form the magnetic brush, which comes into contact with the developing roller 150.

As shown in FIG. 4, a longitudinal end portion 152*e* of the toner supporting side magnetic member 152 is positioned more longitudinally outside than longitudinal end portions 132*e* to 136*e* of the developer supporting side magnetic members 132 to 136. The end portion 152*e* is positioned more outward than the end portions 132*e* to 136*e* by 2.0 to 3.5 mm, for example.

A surface 156 of a longitudinal end portion of the second rotating sleeve 151 that is positioned more outward than the end portions 132*e* to 136*e* of the developer supporting side magnetic members 132 to 136 of the magnetic roller 130 is formed to be low adherent with a surface property of low adherence. The surface of low adherence has a lower toner adherence and higher dielectric constant than the surface 157, which is positioned more longitudinally inward than the surface 156 of the longitudinal end portion.

It may be that an inner end edge of the surface of low adherence is positioned either corresponding to the end portions 132*e* to 136*e* of the developer supporting side magnetic members 132 to 136, or slightly inside or outside the end portions 132*e* to 136*e*. The inner end edge of the surface of low adherence may be positioned either inside or outside the end portions 132*e* to 136*e* by 0 to 1.0 mm, for example.

The surface of low adherence is composed of a resin layer of low adherence, for example a fluoride-including layer. The adherence of the toner 192 depends on critical surface tension. High critical surface tension results in high toner adherence and low critical surface tension results in low toner adherence.

Next, operation of the developing device 16*a* according to the present embodiment is described hereinafter with reference to FIGS. 2 to 5.

In a case of normal development, the second bias voltage is applied via the second voltage application unit 262 in the developing device 16*a* according to the present embodiment. In this state, the two-component developer 190 supplied from the toner cartridge 5*a* (see FIG. 1) is agitated by the agitation rollers 120*a*, 120*b*, and subsequently circulates inside the developer container 110. As a result, the two-component developer 190 thus agitated generates static electricity due to friction, which negatively charges the magnetic carrier 191 and positively charges the toner 192. With an electrostatic force, the toner 192 adheres to the magnetic carrier 191.

The two-component developer 190 thus charged inside the developer container 110 is retained on the surface of the magnetic roller 130 rotating in the rotational direction B due to magnetic forces applied by the developer supporting side magnetic members 132 to 136 provided inside the first rotating sleeve 131. In addition, the developer layer (magnetic brush) 194 is formed on the surface of the magnetic roller 130 by magnetic forces applied by the plurality of developer supporting side magnetic members 134, 135.

The developer layer 194 formed on the surface of the magnetic roller 130 rotationally moves following rotation of the first rotating sleeve 131 and comes in contact with the layer thickness regulating blade 140 to be regulated to a predetermined layer thickness.

The developer layer 194 regulated to the predetermined layer thickness by the layer thickness regulating blade 140 rotationally moves to a vicinity, at which the first developer supporting side magnetic member 132 of the magnetic roller 130 and the toner supporting side magnetic member 152 of the developing roller 150 face each other, to reach a region in which the first magnetic field 171 is generated, following rotation of the magnetic roller 130. In this region, the developer layer 194 rises under the influence of the first magnetic field 171 to form the magnetic brush that comes in contact with the developing roller 150.

As shown in FIG. 3, the positively charged toner 192 in the developer layer 194 in contact with the developing roller 150 is transferred to the developing roller 150 according to a potential difference between the first bias voltage applied to the magnetic roller 130 and the second bias voltage applied to the developing roller 150 through the second voltage application unit 262. Accordingly, the toner layer 193 of the predetermined thickness is formed on the surface of the developing roller 150.

When the toner 192 in the developer layer 194 is transferred from the magnetic roller 130 to the developing roller 150, a part of the toner 192 is also transferred to the surface 156 of the longitudinal end portion of the second rotating sleeve 151 of the developing roller 150. Since the surface 156 of the longitudinal end portion of the second rotating sleeve 151 of the developing roller 150 is of a surface of low adherence with low toner adherence and a high dielectric constant, an amount of the toner 192 adhering to the surface 156 is extremely small.

Thereafter, an instruction of forming an image (printing) on a sheet of paper T is made by a user to the copy machine 1. The user's printing instruction to the copy machine 1 may either be an, instruction of printing an image on a sheet of paper T or an instruction of printing an image successively on a plurality of sheets of paper T.

The instruction for printing an image on a sheet of paper T triggers the copy machine 1 to start printing of the sheet of paper T.

The developing device 16*e* develops an electrostatic latent image formed on the photosensitive drum 2*a* using the toner layer 193 of the predetermined thickness formed on the surface of the developing roller 150.

More specifically, the surface of the developing roller 150 on which the toner layer 193 is formed faces the surface of the photosensitive drum 2*a* (see FIG. 2) downstream in the rotational direction C. A potential difference between the developing roller 150 and the photosensitive drum 2*a* develops the electrostatic latent image in a developing region. In other words, an electrostatic latent image is formed on the surface of the photosensitive drum 2*a* and a toner image is formed on the electrostatic latent image by the toner supplied from the toner layer 193 of the developing device 16*a*.

And then, as shown in FIG. 1, the toner image developed on the photosensitive drum 2*a* is sequentially transferred onto the intermediate transfer belt 7. The toner image primarily transferred to the intermediate transfer belt 7 is secondarily transferred to a sheet of paper T by the secondary transfer roller 8. The toner image thus secondarily transferred onto the sheet of paper T is conveyed to the fusing unit 9 and the toner is fused onto the sheet of paper T by the fusing unit 9.

Subsequently, the sheet of paper T is fed to the first discharge portion 50*a* via the third paper path L3 and discharged from the first discharge portion 50*a* to the discharged paper collection part M1. Printing of a sheet of paper T by the copy machine 1 is thus completed.

The first bias voltage applied to the magnetic roller 130 via the first voltage application unit 261 is controlled to be lower at a predetermined timing without development (non-image forming state) than a bias voltage of a normal development. At this predetermined timing, no toner image is formed on the photosensitive drum 2 by the developing device 16, such as a time slot between completion of printing of a sheet of paper T and subsequent printing of another sheet of paper T and a state in which no subsequent printing instruction is made. As a result, the toner 192 composing the toner layer 193 formed on the developing roller 150 is transferred from the developing roller 150 to the magnetic roller 130 by the magnetic brush.

In other words, the operation is switched to a toner layer stripping operation in which the toner 192 composing the toner layer 193 formed on the surface of the second rotating sleeve 151 of the developing roller 150 is stripped.

As shown in FIG. 5, the developer including the toner 192 stripped and migrated from the surface of the second rotating sleeve 151 of the developing roller 150 is conveyed to a portion where homopolar developer supporting side magnetic members are aligned, following rotation of the magnetic roller 130. With a magnetic force generated at this portion, the developer including the toner 192 is separated from the surface of the first rotating sleeve 131 of the magnetic roller 130 and drops into the developer container 110. The developer including the toner 192 having dropped into the developer container 110 is agitated and electrically charged by the agitation rollers 120*a*, 120*b*.

In the toner layer stripping operation, the toner 192 composing the toner layer 193 of the surface 157 positioned more inward than the surface 156 of the longitudinal end portion of the second rotating sleeve 151 of the developing roller 150 is infallibly stripped by the magnetic brush under an influence of the electric field of the first bias voltage lower than that of a normal development, and migrates from the developing roller 150 to the magnetic roller 130.

In contrast, the toner 192 hardly adheres to the surface 156 of the longitudinal end portion of the second rotating sleeve 151 of the developing roller 150 as described above in the normal development. As a result, even a weak rubbing force of the magnetic brush can strip the adhered toner 192 sufficiently.

Upon beginning of a subsequent developing operation, the toner 192 inside the developer layer 194 that is positively charged according to a potential difference between the first bias voltage and the second bias voltage is transferred to the developing roller 150 as shown in FIG. 3, following formation of the developer layer (magnetic brush) 194 on the surface of the magnetic roller 130 and regulation of the developer layer 194 to a predetermined thickness by the layer thickness regulating blade 140. In this manner, a new toner layer 193 of the predetermined thickness is formed on the surface of the developing roller 150.

Since the surface 156 of the longitudinal end portion of the second rotating sleeve 151 of the developing roller 150 is a surface of low adherence with low toner adherence and a high dielectric constant, an amount of the toner 192 adhering to (remaining on) the surface 156 of the longitudinal end portion of the second rotating sleeve 151 is extremely small even for a case where the new toner layer 193 is formed on the surface of the developing roller 150. As a result, it is possible to decrease undesired image overlapping generated at both end portions of the toner image on the surface of the photosensitive drum 2*a* due to the adhered toner 192 being electrically charged.

The developing device 16*a* in the copy machine 1 of the present embodiment provides, for example, the following effects.

In the present embodiment, the longitudinal end portion 152*e* of the toner supporting side magnetic member 152 is positioned more longitudinally outside than the longitudinal end portions 132*e* to 136*e* of the developer supporting side magnetic members 132 to 136. In addition, the surface 156 of the second rotating sleeve 151 positioned more outside than the end portions 132*e* to 136*e* of the developer supporting side magnetic members 132 to 136 is composed of the surface of low adherence with lower toner adherence and a higher dielectric constant than those of the surface 157 positioned on an inner side thereof.

Accordingly, it is possible to prevent the toner from adhering to the surface 156 of the longitudinal end portion of the second rotating sleeve 151 of the developing roller 150 in the developing operation. When a small amount of the toner adheres to the surface 156, it is possible to sufficiently strip the toner 192 adhering to the surface 156 by a weak rubbing force of the magnetic brush, if the toner layer stripping operation is performed at a predetermined timing without development (non-image forming state) at which no toner image is formed on the photosensitive drum 2*a* by the developing device 16*a*. Accordingly, it is possible to decrease a phenomenon in which the toner adhering to the surface 156 of the longitudinal end portion of the second rotating sleeve 151 is electrically charged to overlap with both end portions of the toner image on the surface of the photosensitive drum 2*a* (undesired image overlapping). In this manner, it is possible to prevent image defect resulting from the undesired image overlapping.

Furthermore, in the present embodiment, the surface 156 of the longitudinal end portion of the second rotating sleeve 151 of the developing roller 150 is composed of a surface of low adherence with lower toner adherence and a higher dielectric constant than those of the surface 157 positioned more inward thereof.

Since it is possible to lower the intensity of electric field between the magnetic roller 130 and the developing roller 150, it is possible to decrease an amount of the toner 192 migrating to the developing roller 150 and to cause the toner 192 to hardly migrate from the developing roller 150 to the photosensitive drum 2*a*. Accordingly, it is possible to further decrease undesired image overlapping.

Moreover, in the present embodiment, it is possible to form the surface of low adherence only by providing a thin fluoride-including layer on the surface of longitudinal end portion of the second rotating sleeve 151 in the developing roller 150.

Accordingly, it will not be necessary to adopt complex and expensive means for stripping and collecting the adhering toner from the developing roller 150 to the magnetic roller 130. Examples of such means may include a dedicated control unit configured to control a value of the bias voltage applied, as well as a duration of applying an alternating component of the bias voltage for stripping and collecting, and a control unit configured to broadly set the half width region, in which magnetic flux density is one-half of a peak value of the magnetic member provided inside the magnetic roller 130. As a result, it is possible to simplify a configuration of the entire apparatus and realize a reduction in cost.

A preferred embodiment of the present disclosure has been described above. However, the present disclosure is not limited thereto and may be carried out in various modes.

For example, a case in which the toner 192 is positively charged has been described in the above embodiment. However, the present disclosure is not limited thereto. Alternatively, the toner 192 may be negatively charged. On the other hand, in the above embodiment, a case of using the positively charged toner 192 has been described. When the positively charged toner 192 is used, it is configured such that a difference between the first bias voltage and the second bias voltage is greater.

On the other hand, when a negatively charged toner 192 is used, it is configured such that a difference between the first bias voltage and the second bias voltage is smaller. In this manner, it is possible to provide effects similar to those of the above embodiment even in a case of using the negatively charged toner 192.

Except for this feature, a configuration, operation and effect are similar to each other between a case of the negatively charged toner 192 and a case of the positively charged toner 192.

The above embodiment has been described for an image forming apparatus of full-color printing employing an indirect transfer system that transfers toner images of a plurality of colors to a sheet of paper T using the intermediate transfer belt 7. However, the image forming apparatus of the present disclosure is not limited thereto. The present disclosure may be applicable to an image forming apparatus employing a direct transfer system without the intermediate transfer belt, or an image forming apparatus for monochromatic printing. The image forming apparatus of the present disclosure is not particularly limited, and may be a color copy machine, a printer, a facsimile machine, or a multi-functional machine having functions thereof.

The sheet-shaped recording medium is not limited to a sheet of paper T, and may be a film sheet, for example.

EXAMPLE

Examples of the present disclosure and Comparative Examples are described with reference to Table-1. It should be noted that the present disclosure is not limited to the following Examples.

In Table 1, an amount of the toner migrating from the magnetic roller 130 to the developing roller 150 is set to 15 mg/cm$^2$ and 25 mg/cm$^2$. The surface of the longitudinal end portion of the developing roller 150 is configured to be a surface of low adherence in Example. In contrast, it is not configured to be a surface of low adherence in Comparative Example. Visual inspection was performed to check whether undesired image overlapping occurred due to the toner adhering to the surface of the longitudinal end portion of the developing roller 150, for Example and Comparative Example which were subjected to endurance testing (successive printing test). In Table 1, a circle indicates absence of undesired image overlapping and an X indicates presence of undesired image overlapping.

TABLE 1

| Volume of successively printed sheets | Toner Migration Amount (mg/cm$^2$) | Comparative Example | Example |
|---|---|---|---|
| 10K | 15 | x | ○ |
| | 25 | ○ | ○ |
| 30K | 15 | x | ○ |
| | 25 | ○ | ○ |
| 60K | 15 | x | ○ |
| | 25 | x | ○ |

Common test conditions for Example and Comparative Example are as follows.

An outer diameter of a magnetic roller: ϕ 20 mm

An outer diameter of a developing roller: ϕ 20 mm

A distance (gap) between the developing roller and a photosensitive drum: 150 μm A distance (gap) between the magnetic roller and the developing roller: 300 μm An average particle size of toner: 6.8 μm An average particle size of a carrier: 35 μm A weight ratio of toner/carrier: 11%

Individual test conditions for Example and Comparative Example are as follows.

A surface of low adherence of a longitudinal end portion of the developing roller in Example: Teflon (registered trademark) of 110 μm in thickness A relative dielectric constant: 7.7 (103 Hz)

Critical surface tension: 25 dyne/cm

A relative dielectric constant of a longitudinal central portion (Example) and a longitudinal entire area (Comparative Example) of the developing roller: 3.0 (103 Hz)

Critical surface tension: 32 dyne/cm

Under the above-presented conditions, the endurance test (successive printing test) was performed for Example and Comparative Example, setting the number of successively printed sheets as 1000 sheets (10 K), 2000 sheets (20 K), and 6000 sheets (30 K).

Results obtained are shown in Table 1. As obvious from the results shown in Table 1, compared with Comparative Example, it was confirmed by the successive printing test with two different toner migration amounts that no undesired image overlapping occurred in Example.

The invention claimed is:

1. A developing device comprising:

a developer supporting rotator including a first rotating sleeve and a developer supporting side magnetic member, the first rotating sleeve supporting a two-component developer including at least a carrier and toner, and composing a longitudinally extending surface, on which a magnetic brush is formed by the carrier contained in the two-component developer, and the developer supporting side magnetic member being disposed inside the first rotating sleeve and longitudinally extending;

a toner supporting rotator including a second rotating sleeve and a toner supporting side magnetic member, the second rotating sleeve being arranged opposite to the developer supporting rotator, composing a longitudinally extending surface, on which the toner supplied from the developer supporting rotator is supported and a toner layer is formed by the magnetic brush, and the toner supporting side magnetic member being disposed inside the second rotating sleeve and longitudinally extending; and a voltage application unit configured to apply a developing bias voltage between the toner supporting rotator and the image carrier, such that the toner supported by the toner supporting rotator flies to an electrostatic latent image on a surface of an image carrier in order to develop the electrostatic latent image into a toner image, wherein a longitudinal end portion of the toner supporting side magnetic member is positioned more longitudinally outside than a longitudinal end portion of the developer supporting side magnetic member, and wherein a surface of the second rotating sleeve positioned more outside than the end of the developer supporting side magnetic member is composed of a surface of low adherence having lower toner adherence and a higher dielectric constant than those of a surface positioned more inside.

2. The developing device according to claim 1, wherein the surface of low adherence comprises a fluoride-including layer.

3. An image forming apparatus comprising:

at least one image carrier;

a transfer unit;

a fusing unit; and a developing device including, a developer supporting rotator including a first rotating sleeve and a developer supporting side magnetic member, the first rotating sleeve supporting a two-component developer including at least a carrier and toner, and composing a longitudinally extending surface, on which a magnetic brush is formed by the carrier contained in the two-component developer, and the developer supporting side magnetic member being disposed inside the first rotating sleeve and longitudinally extending, a toner supporting rotator including a second rotating sleeve and a toner supporting side magnetic member, the second rotating sleeve being arranged opposite to the developer supporting rotator, composing a longitudinally extending surface, on which the toner supplied from the developer supporting rotator is supported and a toner layer is formed by the magnetic brush, and the toner supporting side magnetic member being disposed inside the second rotating sleeve and longitudinally extending, and a voltage application unit configured to apply a developing bias voltage between the toner supporting rotator and the image carrier, such that the toner supported by the toner supporting rotator flies to an electrostatic latent image on a surface of an image carrier in order to develop the electrostatic latent image into a toner image, wherein a longitudinal end portion of the toner supporting side magnetic member is positioned more longitudinally outside than a longitudinal end portion of the developer supporting side magnetic member, wherein a surface of the second rotating sleeve positioned more outside than the end of the developer supporting side magnetic member is composed of a surface of low adherence having lower toner adherence and a higher dielectric constant than those of a surface positioned more inside, wherein the electrostatic latent image is formed on a surface of the at least one image carrier, and a toner image is formed on the electrostatic latent image by the toner supplied from the toner layer of the developing device, wherein the transfer unit directly or indirectly transfers the toner image formed on the image carrier to a sheet-like recording medium, and wherein the fusing unit fuses the toner image thus transferred onto the sheet-like recording medium.

4. The image forming apparatus according to claim 3, wherein the surface of low adherence comprises a fluoride-including layer.

* * * * *